US006132271A

United States Patent [19]

Hebert

[11] Patent Number: 6,132,271

[45] Date of Patent: Oct. 17, 2000

[54] JACK PLATE FOR VERTICAL AND AFT PLACEMENT OF AN OUTBOARD MOTOR

[76] Inventor: Dana Hebert, 125 Ulysse, Lafayette, La. 70506

[21] Appl. No.: 09/350,499

[22] Filed: Jul. 9, 1999

[51] Int. Cl.[7] ..... B63H 5/125

[52] U.S. Cl. ..... 440/59; 440/53

[58] Field of Search ..... 440/53, 61, 63, 440/49, 900, 55, 58, 59

[56] References Cited

U.S. PATENT DOCUMENTS

| | | | |
|---|---|---|---|
| D. 372,452 | 8/1996 | Icenogle | D12/317 |
| 4,143,614 | 3/1979 | Jeanson et al. | 115/41 |
| 4,232,627 | 11/1980 | Glenn et al. | 440/61 |
| 4,482,330 | 11/1984 | Cook | 440/2 |
| 4,624,438 | 11/1986 | Goodman, Jr. | 248/642 |
| 4,757,971 | 7/1988 | Mapes | 248/642 |
| 4,907,993 | 3/1990 | Thompson | 440/61 |
| 5,322,030 | 6/1994 | Brehmer | 114/343 |
| 5,782,662 | 7/1998 | Icenogle | 440/61 |
| 5,944,568 | 8/1999 | Rabal | 440/53 |

*Primary Examiner*—Mark T. Le
*Assistant Examiner*—Patrick Craig Muldoon
*Attorney, Agent, or Firm*—Domingue & Waddell, PLC

[57] ABSTRACT

An apparatus for adjusting the position of a boat motor. The apparatus contains a first transom member extending perpendicular from the transom, with the first member having a first longitudinal slot therein; and a second transom member extending perpendicular from the transom, with the second member having a second longitudinal slot therein. The apparatus further includes an upper plate position between the first and second transom member, with the first plate being attached to the first transom member and the second transom member. Also included is a first motor bracket member slidably connected to the first transom bracket and a second motor bracket member slidably connected to the second transom bracket. The apparatus further includes a lower plate position between the first motor bracket member and the second motor bracket member, with the lower plate being attached to the first motor bracket member and the second motor bracket member. A central bolt having a threaded stem is disposed through a smooth bore in the upper plate and a threaded bore in the lower plate. A rotational force applied to the central bolt will move the lower plate. The movement of the lower plate will lower or raise the motor in relation to the boat's transom.

13 Claims, 5 Drawing Sheets

JACK PLATE FOR VERTICAL AND AFT PLACEMENT OF AN OUTBOARD MOTOR

BACKGROUND OF THE INVENTION

1. Field of Invention

The forward motion of a motor boat in water causes the displacement and subsequent turbulence in the water which is cumulative and greatest just behind the boat. A spinning propeller of an outboard motor in these turbulent water conditions turns, at least in part, in the direction of the turbulent water results in a lessening of forward thrust of the boat. A propeller in undisturbed water can make contact with the water so that the action of the propeller with the water acts to maximally accelerate the boat. The present invention helps the boat operator to position the outboard motor away from the turbulent water to aid in acceleration.

2. Description of Prior Art

To avoid placement of the propeller in the turbulence created by the moving boat, boat operators can position the outboard so as to place the propeller of the outboard in a location where turbulence is at a minimum. Calmer water will be found below and aft of the boat. Traditionally jack plates that attach the outboard motor to the boat have one bracket attached to the boat's transom and the other bracket attached to the outboard motor. The sliding of one bracket against the other bracket is commonly a feature in the devices and provides the movement to raise or lower the outboard motor.

Sliding can be achieved by telescoping tubular elements which are aligned in the longitudinal axes of each of the brackets. The tubes having the greater diameter house the tubular elements of the other bracket and the smaller diameter elements slide within the larger diameter elements to raise or lower the attached motor.

Another means for sliding utilizes side mounted bolts on the transom bracket which fit into and slide within side slots on the outboard bracket. The operator positions the motor, and to maintain the vertical position of the outboard the bolts are tightened. In another jack plate, the side edges of the transom bracket fit into grooves on the outboard bracket. Lubricated bearings aid in the sliding motion. Similarly, in another invention, sliding of the motor mounted bracket against the transom bracket is accomplished by the motor bracket having both tubular and channel fittings that complementarily fit the channel and tubular fittings on the receiving bracket. The fittings are mounted on the side edges of the brackets.

Rather than use a means for sliding of the brackets, the outboard motor can be mechanically lifted as in a separate application. The movement of the transom bracket relative to the motor bracket is accomplished by the brackets being pivotally attached with upper and lower links in the form of steel plates, this design is referred to as the parallelogram design. The upper link is attached to the upper edges of both of the brackets and the lower link is similarly attached to the lower edges. A hydraulic cylinder is mounted between the pivotal links of the motor bracket and the transom bracket so that the lengthening or shortening of the cylinder will raise or lower the motor, respectively.

Hydraulic systems are a conventional part of many of these inventions. The systems include a cylinder attached to both brackets so as to move the transom portion and the outboard portion distant to raise the motor or to move them together to lower the motor. An electrically powered reversible hydraulic pump is used to control the amount of hydraulic fluid in the cylinder. Once the operator has the outboard motor in the desired position the cylinder holds the motor in place.

A jack plate using a ratchet and pawl system to provide the power slides the transom brackets relative to the motor brackets. A nut when turned by a wrench rotates a shaft connected to the transom bracket. A cable connects the shaft to the motor bracket. Rotation of the shaft winds or unwinds the cable around the shaft to raise or lower the motor bracket and motor.

Available devices while primarily attaching the outboard to the boat, secondarily combine components to raise and lower the outboard, supply power for that movement and enable the operator to lock the outboard in position. But outboard motors are routinely exposed to harsh environments with little upkeep. The heaviness of the motor, the maneuvering of the boat and the transport of the motorized boat call for a jack plate that is resilient and stable. Mechanized systems, systems that require lubrication or systems that involve many pieces may not be suited to the conditions in which the motor functions. A need exists for a jack plate that while it attaches the motor to the boat and allows the operator to position the motor into water that optimally increases forward thrust, can weather the conditions of the outdoors in a dependable and stable fashion.

SUMMARY OF INVENTION

In the present invention a central bolt passes through an upper cross-plate support attached to the transom L-brackets and is threadably joined to a lower cross-plate support attached to the motor L-brackets. Using the upper cross-plate as support for the bolt, turning of the central bolt raises or lowers the lower cross-plate and outboard motor. Bolts fastened through the sides of the motor brackets fit into slots cut into the sides of the transom brackets. The side mounted bolts when tightened rigidly hold the jack plate in the desired configuration, preventing rotation around the axis of the central bolt, giving rigidity to the whole device .

The invention herein disclosed includes an apparatus for adjusting the position of a boat motor, with the apparatus being attached to a transom of a boat. The apparatus contains a transom bracket that includes a first transom member extending perpendicular from the transom, with the first member having a first longitudinal slot therein; and a second transom member extending perpendicular from the transom, with the second member having a second longitudinal slot therein.

The apparatus further includes a first plate position between the first and second transom member, with the first plate being attached to the first transom member and the second transom member. A motor bracket is included, with the motor bracket comprising a first motor bracket member slidably connected to the first transom bracket, a second motor bracket member slidably connected to the second transom bracket; and, means for slidably connecting the first motor bracket with the first transom bracket and the second motor bracket with the second transom bracket. The apparatus further includes second plate position between the first motor bracket member and the second motor bracket member, with the second plate being attached to the first motor bracket member and the second motor bracket member. A central bolt having a threaded stem is included so that the central bolt disposed within an opening in the first plate and threadedly engaging a threaded aperture of the second plate.

In the preferred embodiment, the first transom member comprises a first leg and a second leg, with the second leg being oriented at a 90 degree angle to the first leg; and wherein the first leg is attached to the transom and the second leg contains the first longitudinal slot. The second transom member comprises a first leg and a second leg, with the second leg being oriented at a 90 degree angle to the first leg; and wherein the first leg is attached to the transom and the second leg contains the second longitudinal slot. In this embodiment, the first motor bracket comprises a first leg and a second leg, with the second leg being oriented at a 90 degree angle to the first leg; and wherein the first leg is attached to the motor and the second leg is attached to the second plate. The second motor bracket will comprise a first leg and a second leg, with the second leg being oriented at a 90 degree angle to the first leg; and wherein the first leg is attached to the motor and the second leg is attached to the second plate.

Also in the preferred embodiment, the first and second legs of the transom bracket are aligned outwardly in a direction facing away from the first plate and the second plate; and the first and second legs of the motor bracket are also aligned outwardly in a direction facing away from the first plate and the second plate.

Further, the slidably connecting means of the present invention comprises a first pin connected to a first side of the second plate, with the first pin being received through the slot; and a second pin connected to a second side of the second plate, with the second pin being received through the slot.

Several design features of the jack plate lend to the placement of the outboard distant from the boat's transom. Individual elements by their size and connectivity to other elements contributes to placement of the motor maximally aft of the boat without compromise of stability.

The objective of the claimed invention is to help the boat operator position the outboard motor vertically while inherently extending the motor away from the boat. The claimed jack plate was designed to be easy to operate, provide utmost stability and require little to no maintenance.

DETAILED DESCRIPTION OF THE INVENTION

Figure 1:
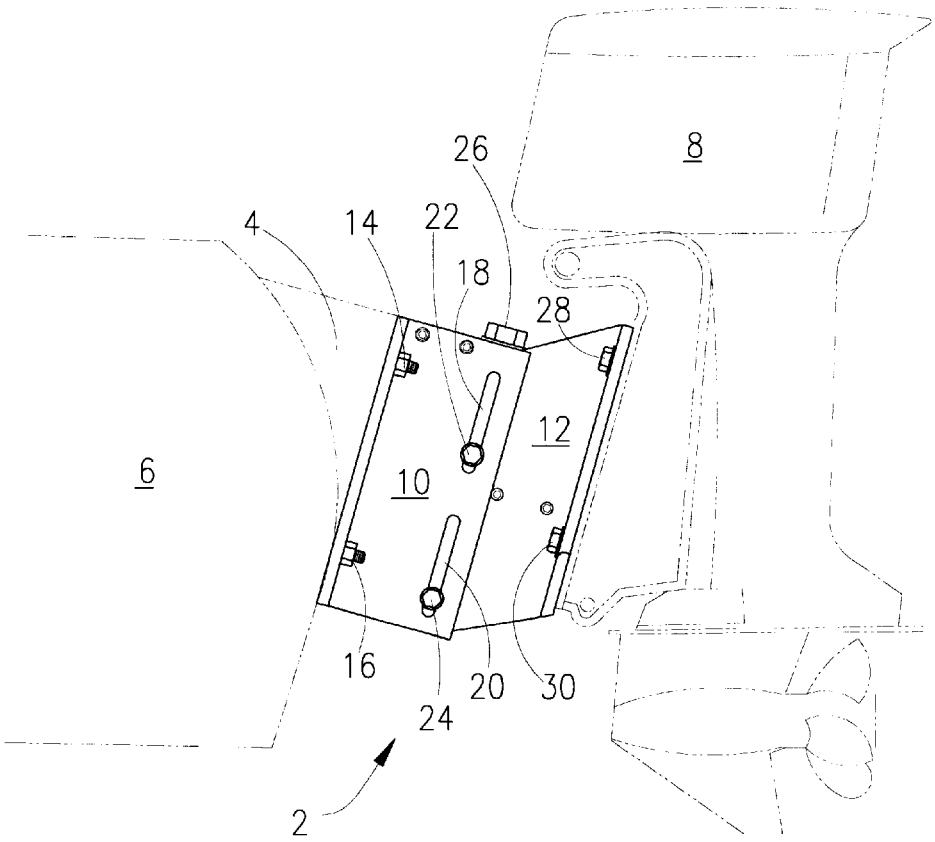
FIG. 1 is a side view of the jack plate secured between the transom of a boat and an outboard motor

Referring now to FIG. 1, the side view of the jack plate 2 secured between the transom 4 of a boat 6 and an outboard motor 8 will now be described. As seen in FIG. 1, a first transom bracket 10 is operatively attached to a first motor bracket 12. The first transom bracket 10 has a nut and bolt attaching means 14, 16 associated therewith for attaching the bracket 10 to the transom 4. The first transom bracket 10 also contains the slot 18 and the second slot 20 with side bolts 22,24 received therein which will be discussed in greater detail later in the application. The central threaded bolt member 26 is depicted. As seen in FIG. 1, the first motor bracket 12 contains a nut and bolt attaching means 28,30 associated therewith for attaching the bracket 12 to the motor 8.

Figure 2:
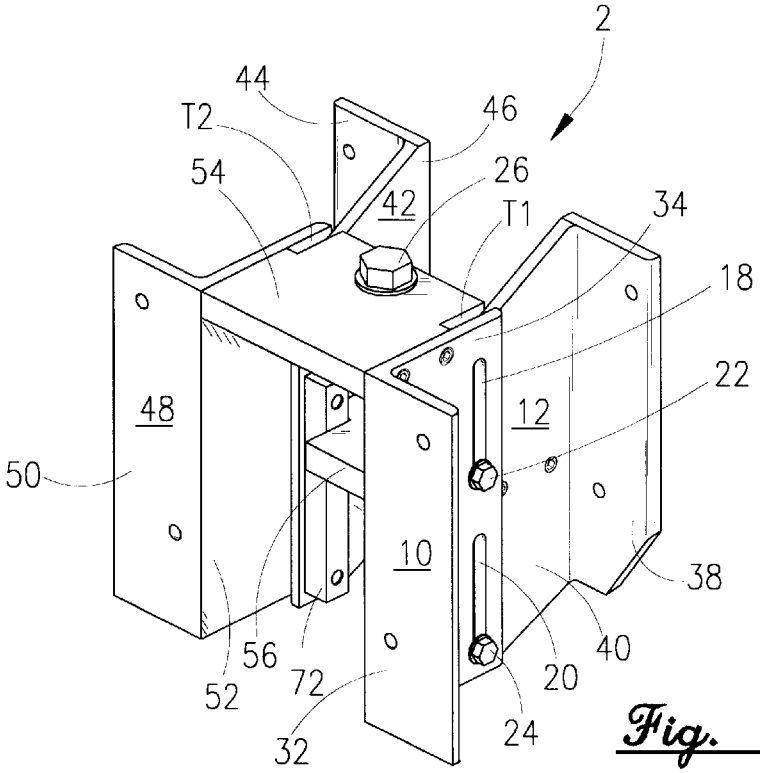
FIG. 2 is an isometric view of the jack plate that attaches to the boat's transom.

FIG. 2 is an isometric view of the jack plate 2 that was seen in FIG. 1. It should be noted that like numbers appearing in the various figures represent like components. The first transom bracket 10 contains a first short leg portion 32 that extends perpendicular to a longer leg portion 34. The first motor bracket 12 contains a first short leg portion 38 that extends perpendicular to a second longer leg portion 40. The jack plate 2 further comprises a second motor bracket 42 that contains a first short leg portion 44 that extends perpendicular to a second longer leg portion 46. FIG. 2 also contains a second transom bracket 48 that includes the short leg 50 that extends perpendicular to the longer leg 52. FIG. 2 further includes a top cross-plate 54 that will be attached to the leg portions 34 and 52. This preferred embodiment further includes a second movable cross-plate 56 that is slidably connected to the transom brackets 10,48 as will be described later in the application. The bottom cross plate 56 contains the threaded aperture 57

Figure 3:
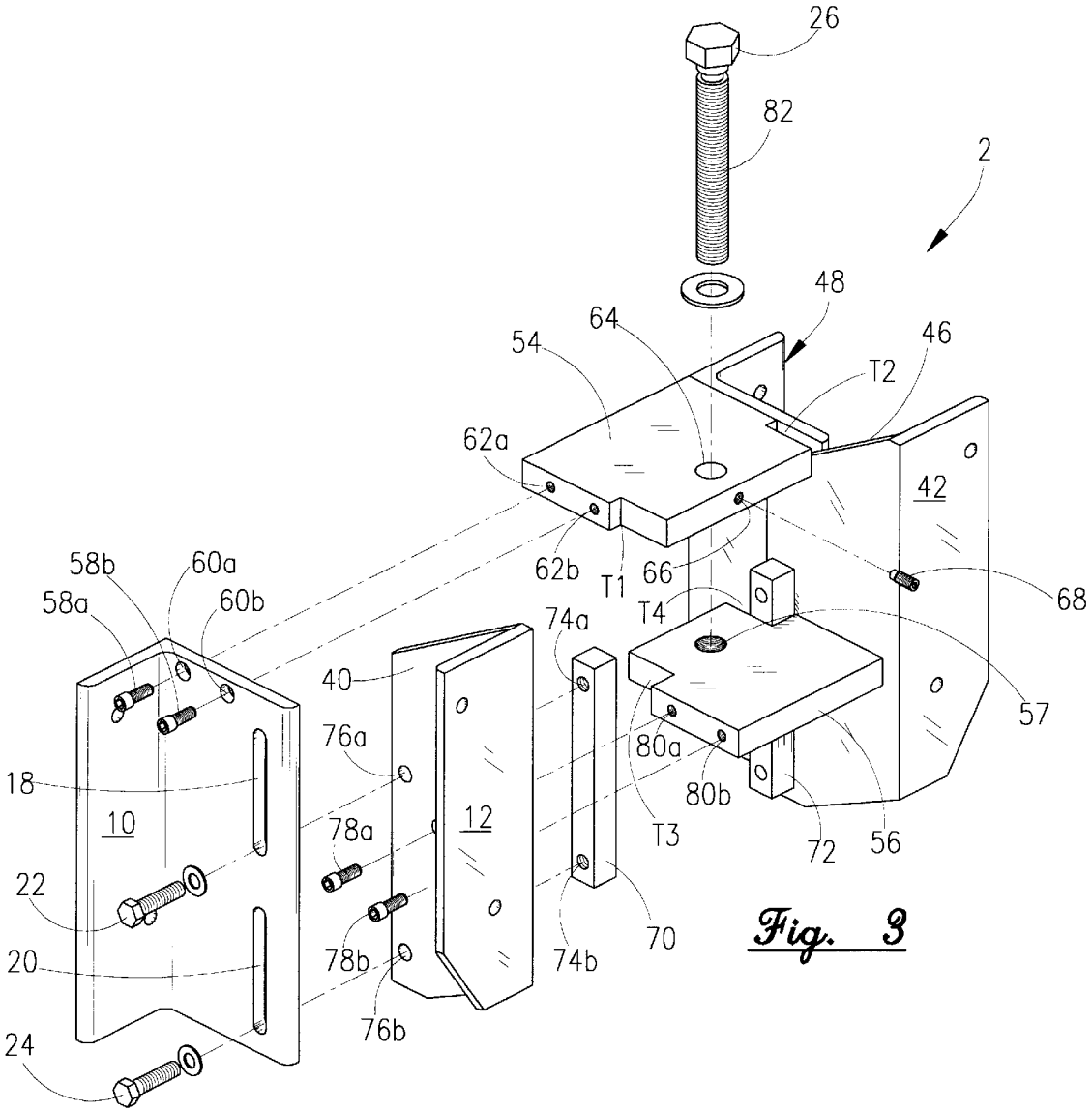
FIG. 3 is an exploded isometric view of the novel jack plate that attaches to the motor showing the various attachments of components.

Referring now to FIG. 3, an isometric exploded view of the jack plate 2 will now be described. Thus, the first transom bracket 10 is shown, with the cooperating first motor bracket 12. The second transom bracket 48 is shown, with the cooperating second motor bracket 42. Additionally, the top plate 54 and the second movable plate 56 is shown. The fasteners (such as screws) 58*a*,58*b* are fitted through the openings 60*a*,60*b* and openings 62*a*,62*b* of the top plate 54. Corresponding fasteners and openings are included in transom bracket 48. The fasteners act to attached the top plate 54 to the transom brackets 10,48. As shown, the top plate 54 is basically flush with the top end of the transom brackets 10,48.

The top plate 54 contains the smooth bore opening 64 which will have disposed therein the central bolt 26. The top plate 54 also contains threaded opening 66 for placement of a set screw 68. The top plate 54 is in the form a "T" with slots T1,T2. The longer leg 46 and longer legs 40 can pass through the T1 and T2 in the raisin and lowering of the motor 8 in accordance with the teachings of the present invention.

Further, there is contained the support brackets 70,72. The support bracket 70 has the threaded openings 74*a*,74*b* and the motor bracket 12 contains the openings 76*a*,76*b* that will allow passage of the side bolts 22,24 therethrough so that the side bolts 22,24 fasten to the support plate 70. The support plate 72 will have corresponding structure and will attach to the motor bracket 42 in a similar fashion. The lower plate 56 is in the form of a "T" with the slots T3,T4, with the slots being configured to receive the support brackets 70,72. FIG. 3 also illustrates the fasteners 78*a*,78*b* that will threadedly engage the openings 80*a*,80*b* through openings in the motor bracket 12 and attached the lower plate 56 to the motor bracket 12. Complementary fasteners are disposed on the opposite end of bracket 42. Therefore, the motor brackets 12,42, support brackets 70,72 and plate 56 are movable as a unit. It should be noted that openings arc included in the short legs 32,48 for attaching bolts to the transom 4 and openings are included in the short legs 38,44 for attaching bolts to the motor 8 as will be understood by those of ordinary skill in the art.

Figure 4:
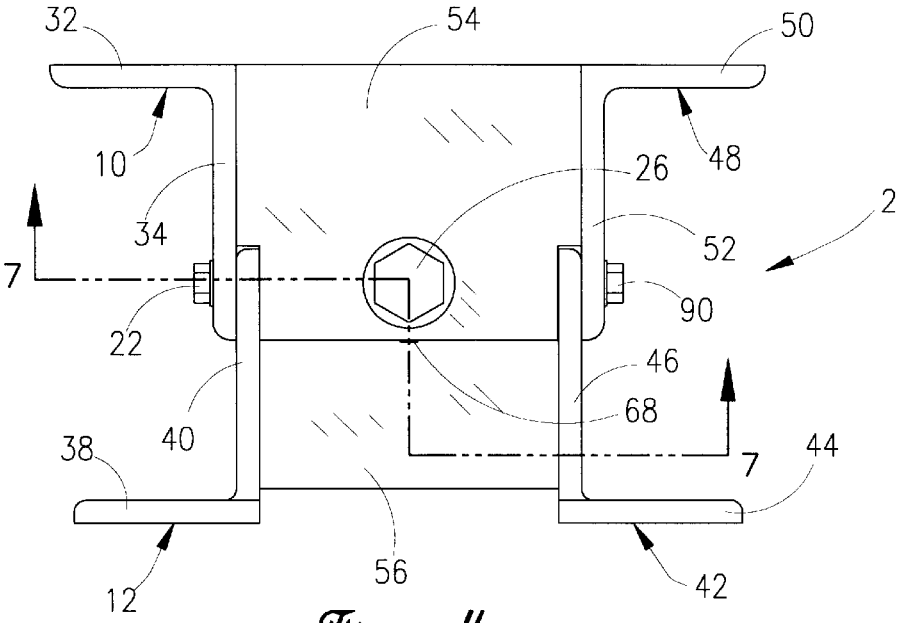
FIG. 4 is an overhead view of the jack plate.

Referring now to an over head view of the novel jack plate 2, FIG. 4 includes the transom brackets 10 and 48 and motor brackets 12 and 42. FIG. 4 depicts the rotatable bolt 26 along with the side bolts 22,90. A feature of the present invention includes the alignment of legs 32 and 50 of the transom brackets outward as well as the outward alignment of legs 38 and 44 of the motor bracket. This design allows for the stationary plate 54, the movable plate 56 and the associated structure to be in the central portion of the jack plate 2. The legs 32,50 of the transom bracket are aligned outwardly in a direction facing away from the first plate 54 and the second plate 56 as seen in FIG. 4. Likewise, the legs 38,44 of the motor bracket are aligned outwardly in a direction facing away from the first plate 54 and the second plate 56 as also seen in FIG. 4.

Figure 5:
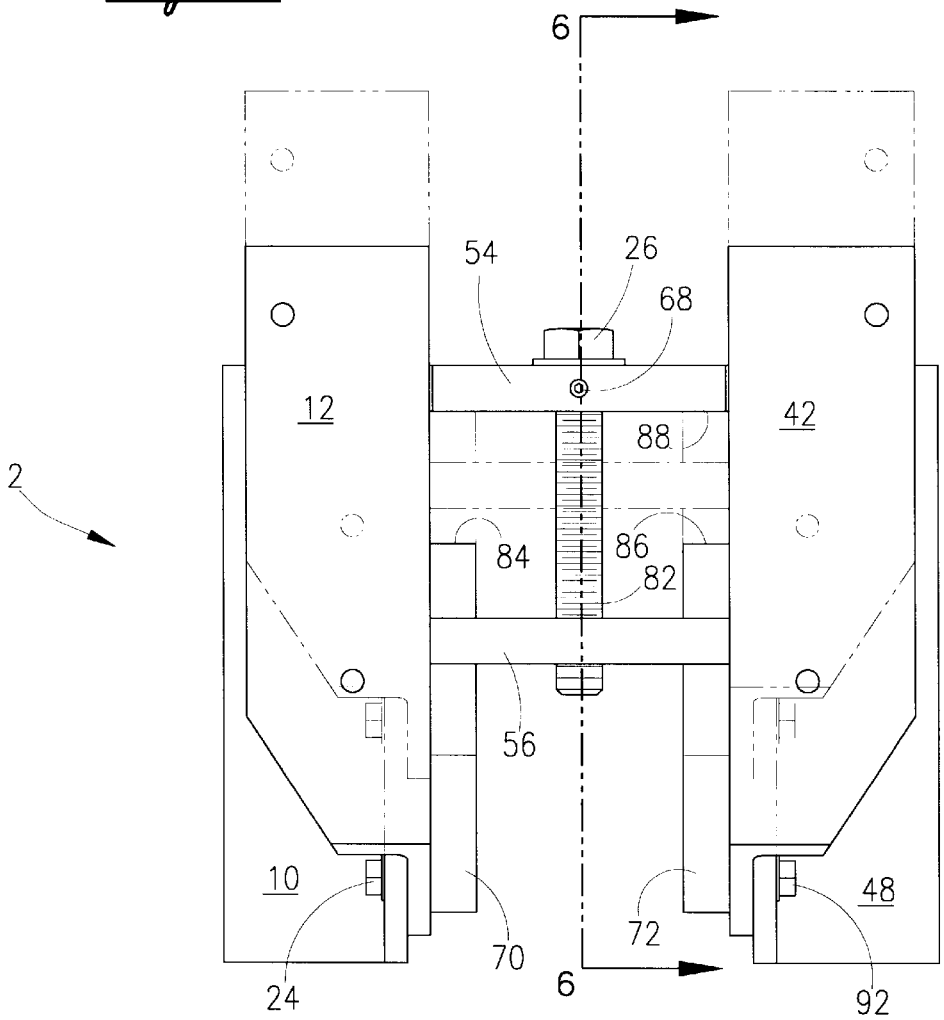
FIG. 5 is a front view of the surface of the jack plate that attaches to the motor further indicating configuration of the jack plate when the motor is in the lowest and highest positions.

FIG. 5 is a front view of the surface of the jack plate 2 that attaches to the motor 8 further indicating configuration of the jack plate 2 when the motor 8 is in the lowest and highest positions. The lowest position is represented by the solid line and the highest position is represented by the phantom line. Thus, assuming the motor 8 is in its lowest position, the plate 56 is as shown by the solid line. The operator would determine which position (height) is appropriate. Therefore, the operator would rotate the bolt member 26. This in turn would cause the threaded shaft 82 to engage the threads within the threaded aperture 57. The rotation will cause the motor brackets 12,42, plate 56, and support brackets 70,72 to rise. The top end 84 of support bracket 70 and the top end 86 of support bracket 72 will abut the bottom surface 88 of the stationary plate 54 and will therefore act as a stop for upward movement.

A cross sectional view through the jack plate 2 taken along line 6—6 of FIG. 5 will now be described. The top plate 54 is shown with the associated set screw 68 in place so that rotation of the bolt 26 is allowed but a longitudinally upward or downward movement is prevented. The bolt 26, and in particular the threaded shaft 82, is engaged with the threaded bore 57 and disposed through the plate 56. The transom bracket is attached to the boat transom 4 and the motor transom 42 will be adaptable to the motor 8.

Figure 7:
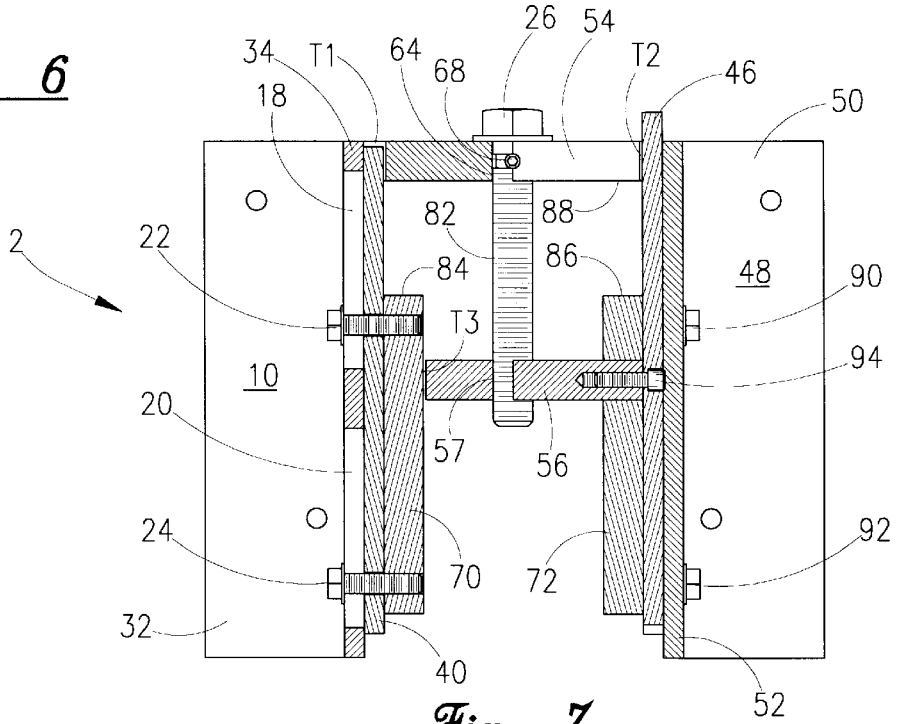
FIG. 7 is a cross section through the jack plate along line 7—7 as indicated in FIG. 4.

Referring now to FIG. 7, a cross-sectional view of the jack plate 2 taken along the line 7—7 of FIG. 4 will now be described. The side bolt 22 is illustrated within the slotted portion 18 and the side bolt 24 is illustrated within the slotted portion 20. As depicted, the side bolts 22,24 are threadedly engaged with the support bracket 70. FIG. 7 also depicts the complimentary side bolts 90,92. The bolt member 26 is received within smooth bore 64 and is threadedly received within the threaded aperture 57 of lower plate 56 via threaded shaft 82. A complimentary fastener 94 to the fasteners 78*a*,78*b* is shown disposed through openings in the longer leg portion 46 and lower plate 56 so that the lower plate and motor bracket 42 are connected together.

Figure 8:
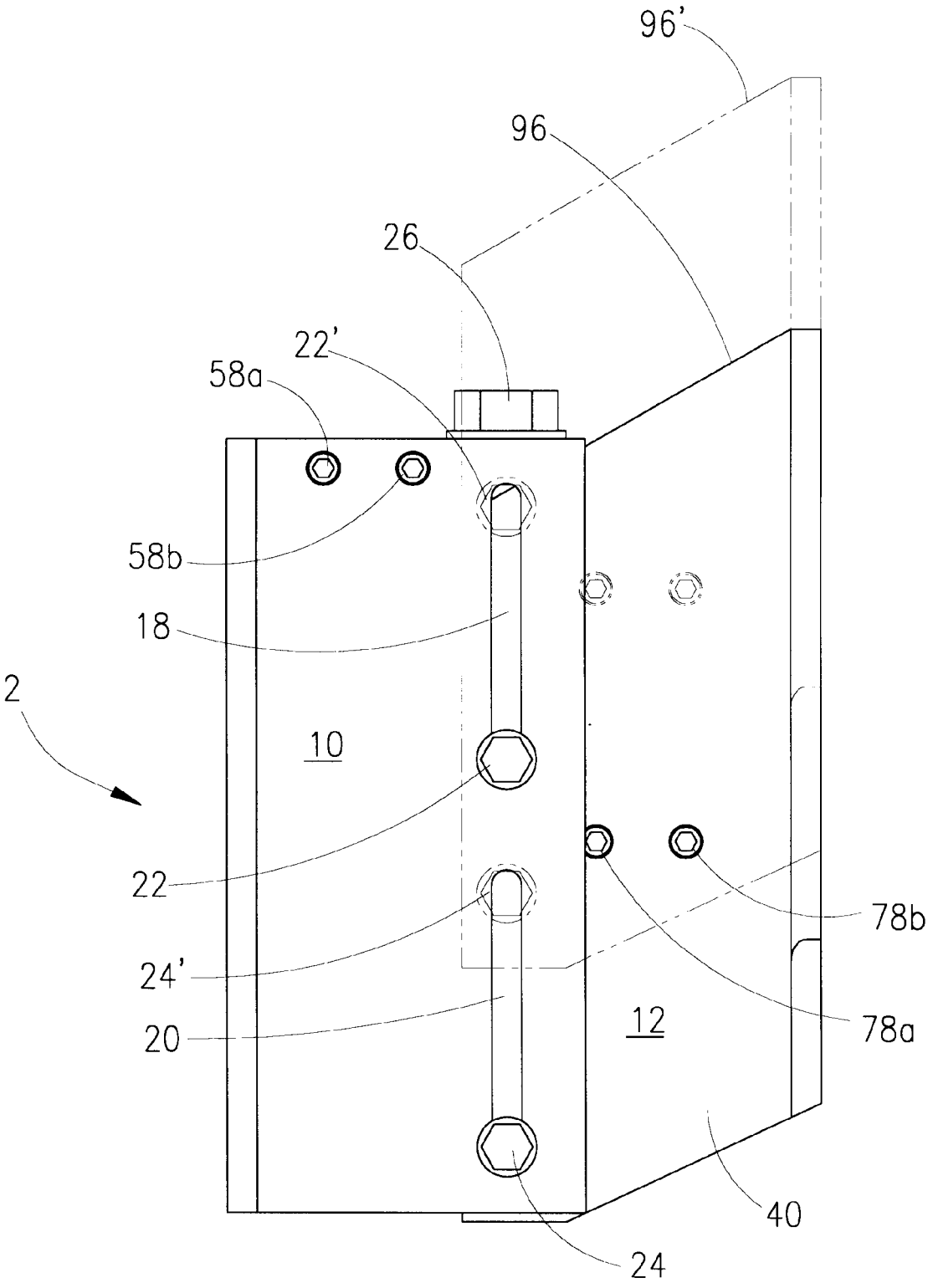
FIG. 8 is a side view of the jack plate indicating the configuration of the jack plate in the lowest and highest positions.

A side view of the jack plate 2 indicating the configuration of the jack plate 2 in the lowest position and the highest position will now be described with reference to FIG. 8. The side bolts 22,24 are shown at the lower end of the slots 18, 20 respectively. The operator would turn the threaded bolt member 26 in a clockwise rotation. This will cause the threaded shaft 82 to engage the threaded bore 57 so that the lower plate 56 travels longitudinally upward.

Figure 6:
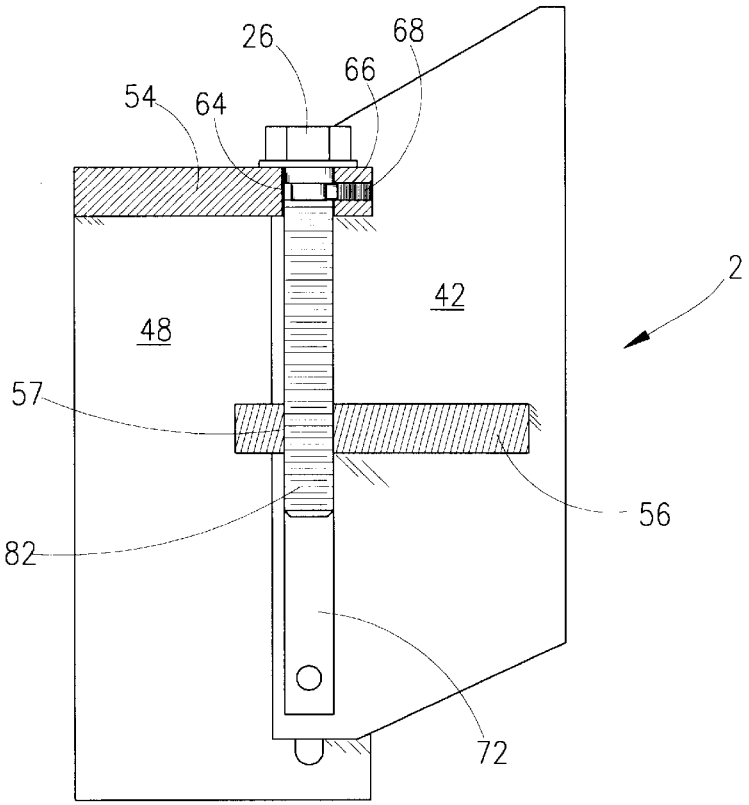
FIG. 6 is a cross section through the jack plate along line 6—6 as indicated in FIG. 5.

The top end 96 of the longer leg portion 40 will travel longitudinally upward to the position represented by the numeral 96'. Likewise, the side bolts 22 and 24 have traveled upward relative to the top plate 54 and are represented by the numerals 22',24' respectively. In this way, the operator can determine by simple rotation force on the central bolt 26 the proper placement of the motor. The operator can then tighten the set screw 68 (as seen in FIG. 6) to prevent unintended rotational movement of the central bolt 26. The operator may adjust the longitudinal position at any time he/she is on the water by simply unfastening the set screw 68, and rotating the central bolt 26 so that the lower plate 56 is corrected positioned, thereafter, the set screw is tighten up to prevent rotation as previously described.

Changes and modifications can be made to the invention herein disclosed and claimed without departing from the spirit and scope of the invention, which is intended to be limited by the appended claims and the proper and legal scope of equivalents thereof

I claim:

1. An apparatus for adjusting the position of a boat motor, said apparatus being attached to a transom of a boat, the apparatus comprising:

a first transom member extending from the transom, said first transom member comprising a first leg and a second leg, with the second leg being oriented at a 90-degree angle to said first leg and wherein said first leg is attached to the boat transom and said second leg contains a first longitudinal slot; and a second separate transom member extending from the transom, said second transom member comprising a first leg and a second leg, with the second leg being oriented at a 90-degree angle to said first leg and wherein said first leg is attached to the boat transom and said second leg contains a second longitudinal slot;

a top cross-plate having a first and second end attached to said first leg of said first transom member and said first leg of said second transom member, and wherein said top cross-plate contains an opening therethrough and wherein said top cross-plate contains a first groove in the first end and a second groove in the second end;

a first motor member slidably connected to said first transom member and wherein said first motor member comprises a first leg and a second leg, with the second leg being oriented at a 90-degree angle to said first leg, a second separate motor member slidably connected to said second transom member and wherein said second motor member comprises a first leg and a second leg, with the second leg being oriented at a 90-degree angle to said first leg and said first and second motor member is adapted to move through said first and second grooves contained on said top cross-plate;

a first bolt connected to said second leg of said first motor member and a second bolt connected to said second leg of said second motor member, said first bolt being received through said first longitudinal slot and said second bolt being received through said second longitudinal slot for slidably connecting said first motor member with said first transom member and said second motor member with said second transom member;

a bottom cross-plate positioned below said top cross-plate, said bottom cross-plate being attached to said second leg of said first motor member and said second leg of said second motor member; and wherein said bottom cross-plate contains a threaded aperture;

and wherein said first leg of said first transom member and said first leg of said second transom member are aligned outwardly in a direction facing away from said top cross-plate and said bottom cross-plate; and wherein said first leg of said first motor member and said first leg of said second motor member is aligned outwardly in a direction facing away from said top cross-plate and said bottom cross-plate;

a central bolt having a threaded stem, said central bolt disposed within said opening in said top cross-plate and threadedly engaging said threaded aperture of said bottom cross-plate so that a rotational movement of said central bolt longitudinally moves said bottom cross-plate.

2. The apparatus of claim 1 further comprising:

a first support bracket connected to said second leg of said first motor member and said bottom cross-plate;

a second support bracket connected to said second leg of said second motor member and said bottom cross-plate.

3. A jack plate comprising:

a. a threaded central bolt that passes through a smooth-bore hole in a stationary upper cross-plate and is threadably connected to a second threaded bore in a movable lower cross-plate;

b. and wherein said upper cross-plate is secured to a top-most edge of a first pair of L-shaped elements which have the shorter base legs attached to a transom of a boat and longer legs that project perpendicularly from the boat and wherein said upper cross-plate is secured to said longer legs;

c. and wherein said lower cross-plate is secured midway along the length of a second pair of separate L-shaped elements which have the shorter base legs attached to an outboard motor and longer legs that project perpendicularly from the motor, said second pair of separate L-shaped elements being movable with said lower cross-plate and wherein said lower cross-plate is secured to said longer legs;

d. at least four threaded side bolts attaching said lower cross-plate to said second pair of L-shaped elements;

e. and wherein said shorter base legs of said first pair of L-shaped elements and said shorter base legs of said second pair of L-shaped elements are aligned outwardly in a direction facing away from said upper cross-plate and said lower cross-plate.

4. The jack plate as recited in claim 3 wherein said upper cross-plate has a smooth-bore hole located near the edge that faces away from the boat.

5. The jack plate as recited in claim 4 wherein said upper cross-plate is attached on left and right sides to the uppermost and inner edges of said pair of transom-attached L-shaped elements with means for preserving the outer surface of said L-shaped elements free of obstructions.

6. The jack plate as recited in claim 5 wherein said upper cross-plate has a motor-facing edge shaped to allow passage of the edge of the longer legs of said second pair of motor-attached L-shaped elements that faces the boat.

7. The jack plate as recited in claim 12 wherein said upper cross-plate has an under surface shaped to fit the top-most edge of said first pair of L-shaped elements.

8. The jack plate as recited in claim 3 wherein said transom-attached pair of L-shaped elements have long narrow guiding slots near to and parallel to the edge of the surface that projects away from the boat.

9. The jack plate as recited in claim 3 wherein said lower cross-plate has a threaded bore located in that portion of the cross-plate that is nearer to the boat.

10. The jack plate as recited in claim 9 wherein said lower cross-plate is attached midway along the length of said second pair of L-shaped elements with means for preserving the outer surface of said L-shaped elements free of obstruction.

11. The jack plate as recited in claim 3 wherein said second pair of L-shaped elements attached to the outboard motor have said longer leg portions that project toward the boat are downwardly angled forming a parallelogram surface.

12. The jack plate as recited in claim 11 wherein said threaded side bolts initially pass through said long narrow slots in said transom-attached L-shaped elements, then pass through said parallelogram surface of said second pair of motor-attached L-shaped elements, and threadably attach to a pair of support ties that are longitudinal with the axis of the jack plate.

13. The jack plate as recited in claim 12 wherein said lower cross-plate is shaped to allow said longitudinal support ties to fit between said lower cross-plate and said longer leg portion of said second pair of motor-attached L elements.

* * * * *